United States Patent [19]

Dzewaltowski

[11] Patent Number: 4,890,424

[45] Date of Patent: Jan. 2, 1990

[54] WORKHEAD WITH WORKPART CHUCK AND WORKPART FLUID BEARING

[75] Inventor: Victor F. Dzewaltowski, Springfield, Vt.

[73] Assignee: Bryant Grinder Corporation, Springfield, Vt.

[21] Appl. No.: 93,218

[22] Filed: Sep. 4, 1987

[51] Int. Cl.[4] ..... B27B 3/16

[52] U.S. Cl. ..... 51/289 R; 51/227 R; 51/238 S; 82/164

[58] Field of Search ..... 82/38 R, 39, 30, 45, 82/DIG. 5, DIG. 6, DIG. 8, 1 C, 164; 51/283 R, 283 S, 237, 227, 289 R, 227, 238 S, 238 R

[56] References Cited

U.S. PATENT DOCUMENTS 3,145,513 8/1964 Porath ..... 82/39
3,209,494 10/1965 Seidel ..... 51/103
4,180,894 1/1980 Link ..... 82/39

FOREIGN PATENT DOCUMENTS 121287 4/1946 Australia ..... 72.3/75.3

*Primary Examiner*—Frederick R. Schmidt
*Assistant Examiner*—Blynn Shideler
*Attorney, Agent, or Firm*—Edward J. Timmer

[57] ABSTRACT

The workhead includes a spindle disposed on a base member and rotatable about a rotational axis. The spindle includes a chuck for fixedly clamping one end of an elongated workpart, such as a valve lifter body, having a bore between opposite ends with the longitudinal axis of the bore substantially coaxial with the rotational axis. A fluid bearing such as a hydrostatic bearing is disposed on the base member adjacent the other end of the workpart for providing pressurized fluid at sufficient locations around the other end to resist machining forces tending to deflect the other end off axis relative to the fixedly clamped end during machining of the bore to improve bore roundness and straightness.

10 Claims, 3 Drawing Sheets

FIG. 3
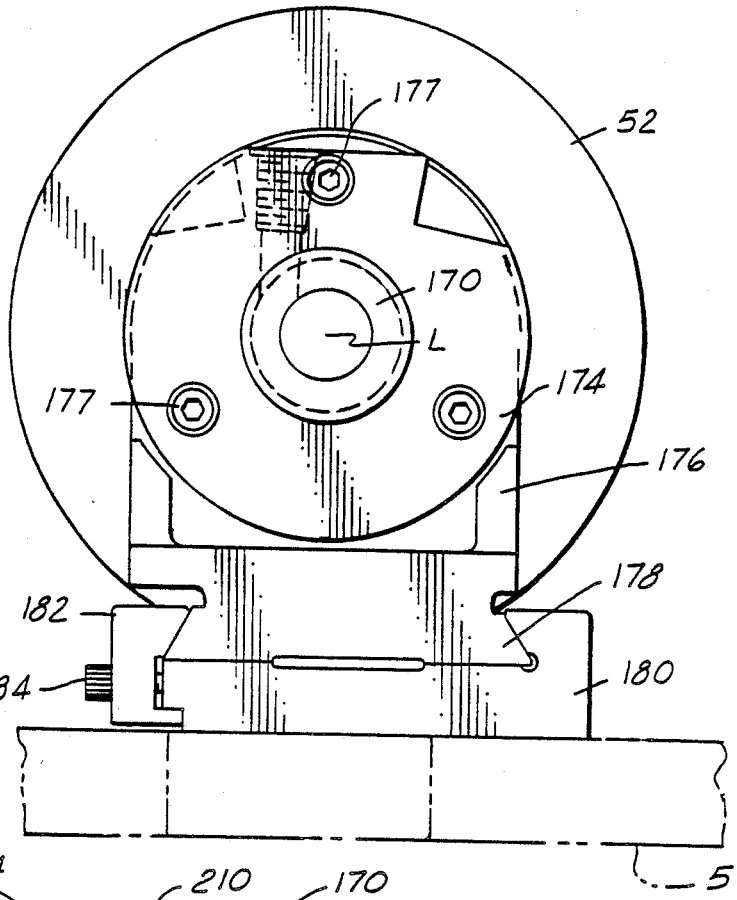
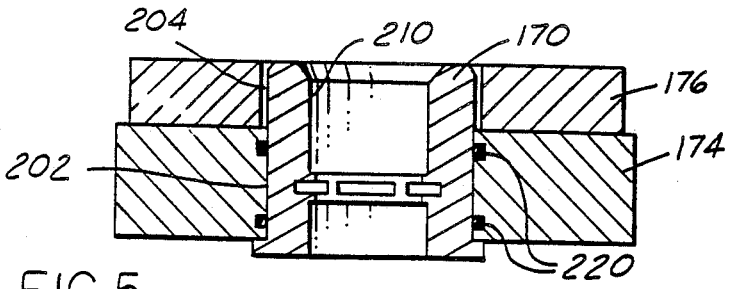
FIG. 5
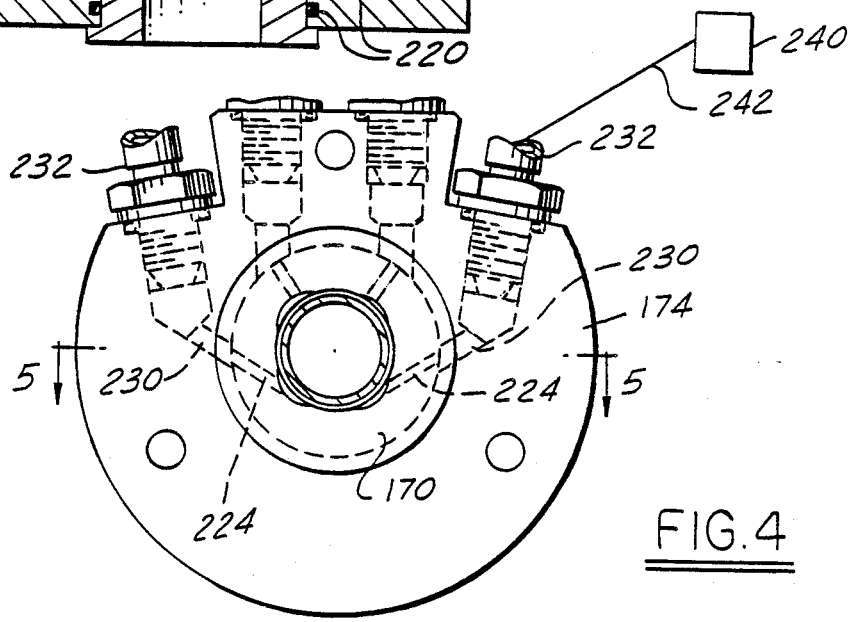
FIG. 4

WORKHEAD WITH WORKPART CHUCK AND WORKPART FLUID BEARING

FIELD OF THE INVENTION

The invention relates to a workhead for a machine tool and method for fixturing a thin wall elongated workpart for a machining operation along its length by engagement with a tool to minimize moments exerted on the workpart by the tool and minimize angular displacement of the longitudinal axis of the workpart from tool forces exerted thereon.

BACKGROUND OF THE INVENTION

Workpieces such as typical automotive engine hydraulic valve lifter bodies often have the configuration of a thin-walled cylindrical tube whose length can be from three to four times the diameter and have one end of the tube closed by an end wall. As a result of the thin wall and length of the tube relative to its diameter, prior art workers have had difficulty in devising a mechanism to fixture the lifter body with sufficient restraint of the body to hold it in desired position for grinding without at the same time elastically deforming the workpart from the fixturing forces and causing resultant increase in roundness and straightness deviation on the ground lifter body.

The lifter body has been gripped in the past by a chuck near the closed end of the lifter body. Oftentimes, this type of fixturing is not sufficient to enable the lifter body to resist grinding forces or moments which are distributed along the entire surface being ground; e.g., along the inner bore of the tube that is ground along its length. The valve lifter body typically is too weak near the open end of the tube to permit gripping by a chuck without elastically deforming the open end.

The Seidel U.S. Pat. No. 3,209,494 issued Oct. 5, 1965, illustrates a method and apparatus for grinding an annular thin wall workpart of relatively short length relative to its diameter to minimize distortion of the thin wall workpart when the grinding force is applied by allowing the annular workpart to laterally and bodily shift to off-center positions relative the longitudinal axis of the fixture. The workpart is thus not fixedly clamped in position during grinding. The fixture that permits such shifting of the position of the workpart includes a support member having a face plate against which one end of the workpart is magnetically held and having multiple fluid passages adjacent the other end to direct fluid against the workpart surface not being machined in a direction to urge the workpart to a centered position. As the workpart shifts off-center from grinding forces exerted thereon, differential fluid pressure is established around the workpart to urge the workpart to return back to the center position.

Australian Pat. No. 121,287 discloses an aircraft engine cylinder that is pressurized from the inside while the outer surface is being ground to prevent distortion of the thin wall of the cylinder from grinding forces and to provide internal cooling action. Both ends of the cylinder are supported by end plates carried on live-centers. The end plates suitably close off the open ends of the cylinder to maintain fluid pressure in the cylinder bore during grinding of the outer surface.

SUMMARY OF THE INVENTION

The invention contemplates a workhead for fixturing and rotating an elongated workpart having a cylindrical bore between opposite ends while the bore is machined by a tool. The workhead includes chuck means on a rotatable spindle means fixedly clamping one end of the workpart with the longitudinal axis of the bore substantially coaxial with the rotational axis of the spindle means and with fluid bearing means around the other end of the workpart for providing pressurized fluid around the other end to resist machining forces tending to deflect the other end off the rotational axis relative to the fixedly clamped end. Roundness and straightness of the machined bore are improved.

In a preferred embodiment of the invention, the spindle means is disposed on a base member and the fluid bearing means is disposed on the base member spaced from the spindle means along the rotational axis. The fluid bearing means includes a bore substantially coaxial with the rotational axis and provides a pressurized fluid film at sufficient locations around the other end to resist the machining forces tending to deflect the other end off-center. The workhead preferably includes means for adjusting the position of the fluid bearing means relative to the spindle means; e.g., the fluid bearing means in a more preferred embodiment is carried on a slide that is movable on the base member toward and away from the spindle means.

A method for fixturing and rotating the workpart referred to above while the bore is machined by a tool is also disclosed.

BRIEF DESCRIPTION OF THE DRAWINGS

FIG. 3 is a front elevation in the direction of arrows 3 in FIG. 1 of the fluid bearing.

FIG. 4 is a front elevation of support plate 174 and hydrostatic bearing.

FIG. 5 is a sectional view along lines 5—5 of FIG. 4.

BEST MODE FOR PRACTICING THE INVENTION

Figure 1:
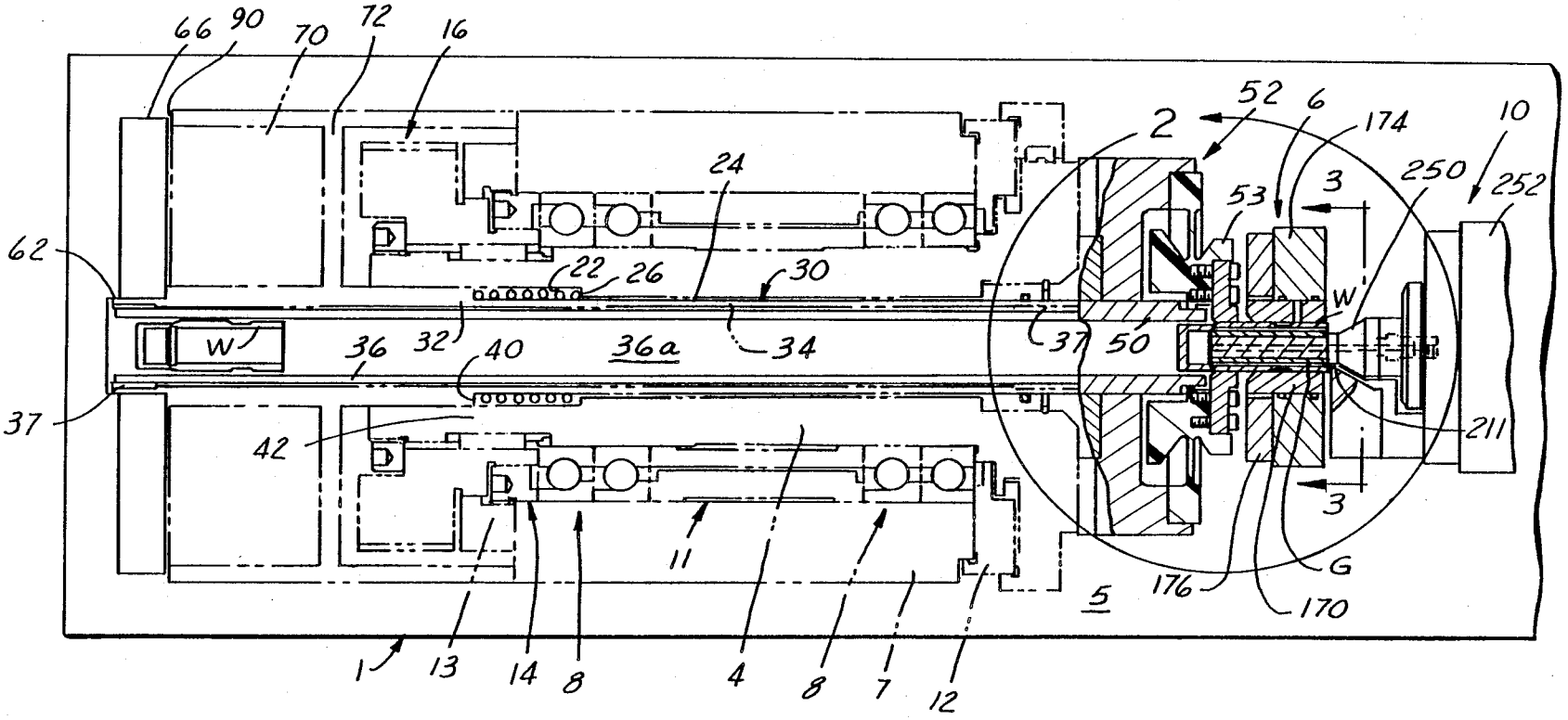
FIG. 1 is a fragmentary section showing the workhead of the invention on a grinding machine with components of the workhead outside the encircled portion shown in phantom.
Figure 2:
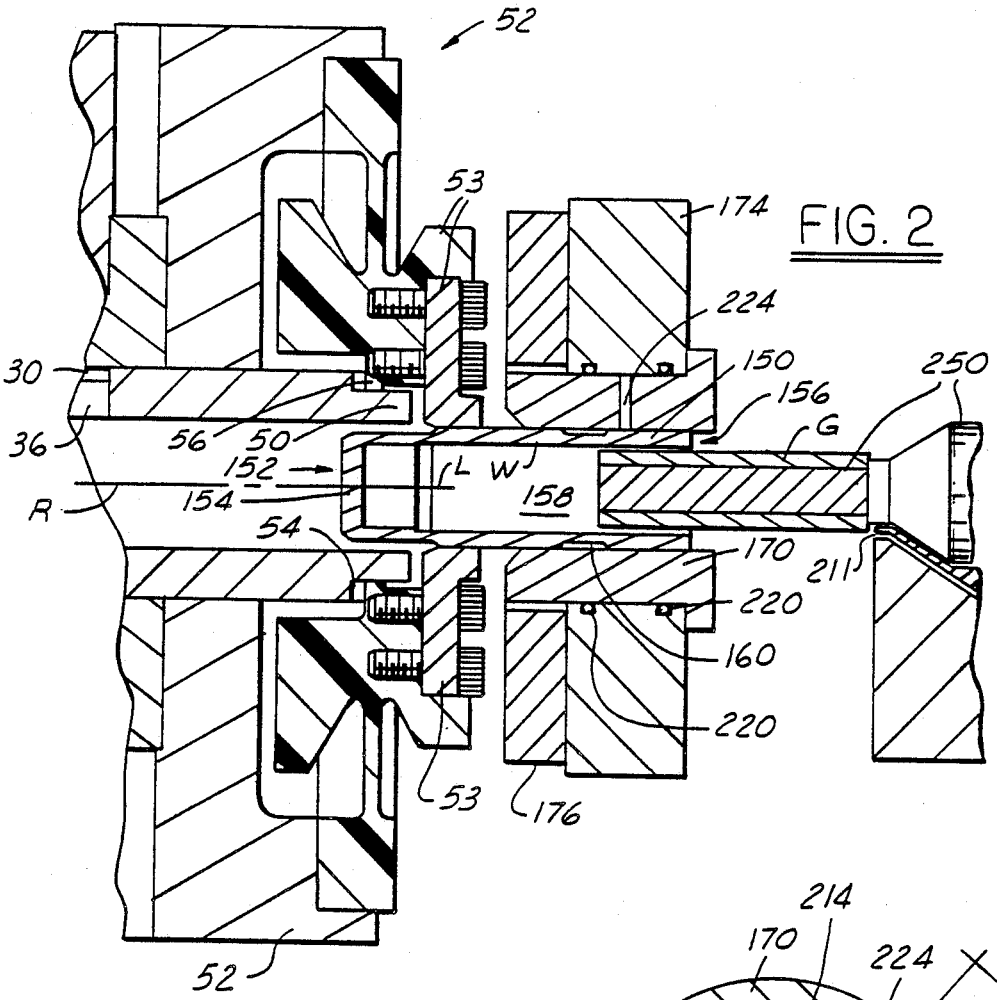
FIG. 2 is a sectional view of the encircled part of FIG. 1.

Referring to FIGS. 1–2, the workhead 1 of the invention includes a spindle 4 disposed on a base member 5, a fluid bearing assembly 6 on the base member and a wheelhead 10 on a conventional compound slide not shown.

The spindle 4 is hollow and rotatably mounted in housing 7 by two pairs of ball bearings 8 spaced apart by spacers 11. The pairs of bearings 8 are fixed in position by forward and rear collars 12,14, the former being affixed to housing 7 by multiple machine screws (not shown) spaced circumferentially therearound and the latter having threads on its outer diameter and being threaded into a ring-shaped member 13 held by machine screws (not shown) to the housing. The spindle 4 is driven in rotation by a toothed drive pulley 16 keyed thereon intermediate the spindle ends. The drive pulley itself is driven by a belt (not shown) and electric motor (not shown) of conventional construction.

The spindle 4 is hollow and includes a longitudinal bore therethrough, the bore having a large diameter portion 22 and smaller diameter portion 24 defining a circumferential shoulder 26 intermediate the spindle ends as shown. Disposed in the bore is a hollow draw rod 30 having a large outer diameter portion 32 received in the large diameter portion 22 of the spindle and a smaller outer diameter portion 34 received in the small diameter portion 24.

A hollow workpart guide tube 36 is disposed in the longitudinal bore of the draw rod by front and rear annular bushings 37 with the guide tube itself having a longitudinal bore 36a through which workparts W are fed in end-to-end relation toward the forward diaphragm chuck 52 as shown in FIGS. 1 and 2. The draw rod rotates with the spindle by being keyed thereto as will be explained. The guide tube also rotates with spindle 4 by virtue of bushings 37 interconnecting it to the draw bar 30.

As shown in FIG. 1, the large and small outer diameter portions 32,34 of the draw rod intersect at a circumferential shoulder 40 which is in spaced facing opposition to circumferential shoulder 26 of the spindle. A coil return spring 42 is positioned between shoulders 26,40 in annular chamber 44 between the draw rod and spindle to bias the draw rod to the left in FIG. 1 for purposes to be explained herebelow.

The draw rod 30 includes a forward end 50 which engages a conventional diaphragm chuck 52 bolted or otherwise fastened to the end face of the spindle as shown in FIG. 1. Movement of the draw rod 30 to the right relative to FIG. 1 will cause the diaphragm chuck jaws 53 to flex away from the workpart W to release same. Movement of the draw rod 30 to the left under action of return spring 42 will cause the chuck jaws to assume the position shown in FIG. 1 to clamp against the workpart. Usually, three or six circumferentially spaced apart chuck jaws 53 are provided on the diaphragm chuck. Typically, the draw rod forward end 50 includes a circumferential outer groove 54 receiving an annular rim 56 on the flexible diaphragm of the chuck to effect engagement therewith. The construction and operation of the diaphragm chuck 52 is well known in the art. Of course, other types of workpart chucks or fixtures operable by the draw rod may be used.

The draw rod 30 includes the longitudinal bore containing guide tube 36 through which workparts W to be internally ground by grinding wheel G are fed successively. Suitable means known to those in the art can be used to advance the workparts through the bore of the guide tube.

The rear end 62 of the draw rod has affixedly fastened thereto an annular collar or flange 66 for rotation with the draw rod and spindle. The flange 66 is made of magnetically permeable material such as steel. Axially adjacent the flange 66 and circumferentially disposed around the draw rod 30 is an annular coil 70 forming an electromagnet means when energized by passage of electrical current therethrough. The coil 70 is stationary and supported in a magnetically permeable coil housing 72 which is fastened to the workhead housing 7. When the coil 70 is energized, the magnetic flux generated jumps the air gap 90 and the magnetic flux force or effect on draw rod flange 66 tends to pull the draw rod flange 66 to the right in FIG. 1 and this action causes the draw rod to slide to the right against the bias of return spring 42 to resiliently flex the workpart chuck 52 and jaws 53 away from the workpart to release same. Upon de-energization of the coil 70, the return spring 42 biases the draw rod 30 leftward to cause the chuck jaws 53 to engage the workpart W.

A preferred spindle of the type described hereinabove is shown in copending U.S. patent application Ser. No. 739,747 filed May 31, 1985 in the names of Victor F. Dzewaltowski et al entitled "Workhead With Electro-Magnet Actuated Chuck", the teachings of which are incorporated herein by reference.

As shown in FIG. 2, the workpart W comprises a valve lifter body in the form of an elongated thin wall cylindrical tubular body 150 having one end closed by endwall 154 and another opposite end 156 that is open. The tubular body defines a cylindrical bore 158 to be ground to final inner diameter by grinding wheel G with bore roundness and straightness maintained within preselected tolerances. As shown, the outer surface of tubular body 150 may include a circumferential groove 160. The wall thickness of tubular body 150 defining bore 158 is typically 0.1 inch.

It is apparent that the length of tubular body 150 is 3 to 4 times the outer diameter thereof. During grinding of bore 158, the chuck jaws 53 fixedly hold and grip the valve lifter adjacent end 152 with the longitudinal axis L of bore 158 substantially coaxial with rotational axis R of the spindle shaft 4. As is known, grinding wheel G is fed radially against the wall defining bore 158 while being reciprocated and rotated in the bore 158. Spindle shaft 4 rotates workpart W during grinding at a slower rate than rotation of grinding wheel G as is known.

As a result of the radial feeding of the grinding wheel against the wall defining bore 158 in combination with the reciprocating and rotational movement thereof, grinding forces are exerted on the thin walled tubular body 150 that tend to deflect portions thereof. The relatively great length of the workpart W combined with these grinding forces create relatively great moments which must be resisted by forces acting between the chuck jaws 53 and the relatively thin wall of body 150, with the undesirable results of localized deformation of the thin wall of body 150 in the vicinity of chuck jaws 53 plus the overall angular displacement of the longitudinal axis L of bore 158 from its initial coaxiality with rotational axis R of the spindle shaft 4. This deformation and displacement result in deviations in roundness and straightness of the bore 158 as ground by wheel G.

Figure 7:
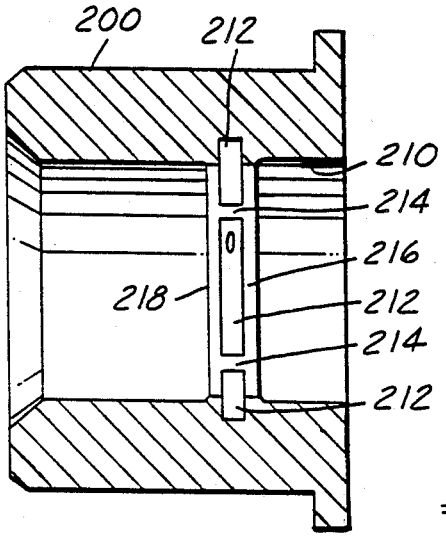
FIG. 7 is a longitudinal sectional view of the hydrostatic bearing taken along lines 7—7 of FIG. 6.

In accordance with the invention, the fluid bearing assembly 6 is disposed on base member 5. FIGS. 214 7 show the fluid bearing assembly 6 as including a hydrostatic bearing 170 received in adjacent support plates 174,176 held together by machine screws 177. Support plate 176 extends and is attached to or integral with a dovetail slide 178 that is slidable in the direction of rotational axis R toward and away from the workpart W held in chuck jaws 53. Support plate 176 slides relative to a fixed slideway 180 on the base member 5. Slide 178 carries the hydrostatic bearing 170 to an adjusted position relative to end 156 of the workpart for purposes to be explained.

Once in adjusted position and during grinding of the workpart, the slide 178 is locked in adjusted position by side clamp 182 via one or more machine screws 184 threaded into slideway 180 so as to clamp the dovetail of slide 178 in the dovetail defined by slideway 180 and clamp 182.

Figure 6:
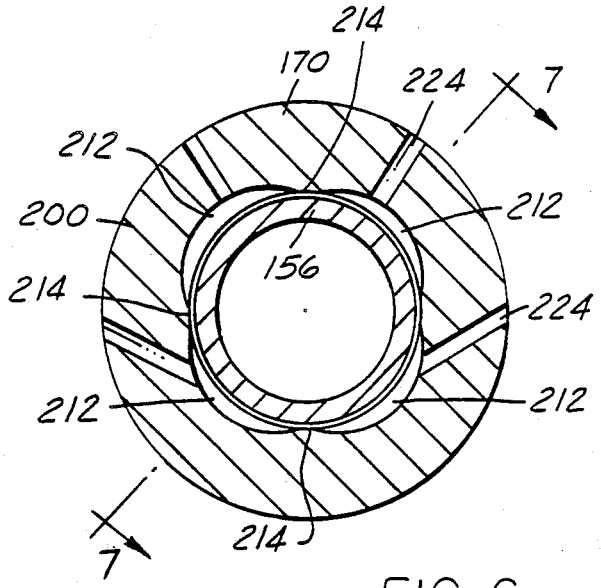
FIG. 6 is transverse sectional view of the hydrostatic bearing.

The hydrostatic bearing 170 includes a cylindrical body 200 received in coaxial bores 202,204 in support plates 174,176. The cylindrical body 200 includes a longitudinal bore 210 having a longitudinal axis substantially coaxial with rotational axis R. As is apparent from FIG. 1, bore 210 receives end 156 of workpart W. Referring to FIGS. 6 and 7, inner bore 210 of the hydrostatic bearing includes four recessed radius-defined pockets 212 spaced apart circumferentially around the bore. Adjacent pockets 212 are separated circumferentially by a raised land 214. Lands 214 are on an inner diameter slightly less than the inner diameter forming bore 210. On opposite axial sides of the pockets 210 are circumferentially extending raised lands 216,218 also on the same inner bore diameter as lands 214. Lands 214,216,218 bound the pockets 212 so that each pocket 212 provides a pool of pressurized fluid such as pressurized liquid when connected to a source of pressurized fluid as will be explained.

The inner diameter of lands 214 and lands 216,218 is equal and is slightly greater; e.g. 0.5 mils, than that of the outer diameter of end 156 of tubular body 150 to be received therein.

The cylindrical body 200 of hydrostatic bearing 170 is press fit in bore 202 and a pair of o-rings 220 are disposed between body 200 and the plate 174 for fluid sealing action.

The body 170 includes fluid passage 224 extending from the circumference of the body to each pocket 212. Each passage 224 in turn is registered with a passage 230 in support plate 174 receiving pressurized fluid from a suitable fitting 232. Each pair of passages 224 and 230 are in fluid flow registry between o-ring seals 220 to prevent escape of fluid from the interface between the hydrostatic bearing and support plate 174. Fittings 232 are each connected to a source 240 of pressurized fluid such as a fluid pump through a suitable supply line 242, and each fitting 232 contains a flow restrictor. Source 240 may supply fluid to all of fittings 232. Or, separate sources for each fitting may be used. Typically, the fluid will comprise the grinding liquid coolant that has been previously discharged onto bore 158 from coolant nozzle 211 mounted on wheelhead 10 during grinding and that has been filtered to remove possibly damaging particles.

The pockets 212 provide pools of pressurized fluid whose pressure and dimensions, both circumferential and axial, are sufficient to resist grinding forces exerted adjacent end 156 of the workpart W. Fluid supply pressure of about 600 psi for filtered grinding coolant such as MINERALSEAL (trademark of Metalworking Lubricants Co., 49 Mascola Road, South Windsor, Conn. 06074) or HONILO 488 (trademark of Castrol Inc., 775 Luif Dr., Warminster, Pa. 18974) has been found satisfactory to provide sufficient resistance to such grinding forces to substantially prevent angular displacement of the longitudinal axis L adjacent end 156 of the workpart from grinding forces. Preferably, pockets 212 collectively extend around the full circumference of workpart W and over as much length of the workpart as exterior geometry of the workpart permits to provide stiff support near end 156. Thus, the hydrostatic bearing !70 provides sufficiently stiff support near end 156 to substantially prevent angular displacement of the workpart axis and thereby improve roundness and straightness of the ground bore.

Pressurized coolant escaping from between the hydrostatic bearing 170 and end 156 of the workpart through the clearances therebetween is collected and filtered for reuse along with coolant flowing out of bore 158 which was placed there by nozzle 211.

As shown in FIG. 1, grinding wheel G is hollow cylindrical in shape and is carried on a quill shaft 250. Quill shaft 250 is held on wheel head 10 by suitable means for rotation by an electric or other motor 252 on the wheel head. As is well known, the wheel head 10 is carried on a compound slide (not shown) that is reciprocated along an axis parallel with rotational axis R and longitudinal axis L and fed perpendicular to said axes by suitable motor means (not shown) e.g., as shown in the Reda et al U.S. Pat. No. 4,419,612 issued Dec. 6, 1985, and Farmer U.S. Pat. No. 4,653,235 issued Mar. 31, 1987, both of which are incorporated herein by reference.

Although the workhead and method have been described in detail hereinabove with respect to carrying out a grinding operation on the workpart and is especially useful in such operations to improve roundness and straightness of the ground bore, they may have use in material removal processes other than grinding. And, although certain preferred features and embodiments of the invention have been described hereinabove and illustrated in the Figures, it is to be understood that modifications and changes can be made therein without departing from the spirit and scope of the invention as defined in the appended claims.

I claim:

1. A workhead for fixturing and rotating an elongated workpart having a thin-wall defining a cylindrical bore between opposite ends while the bore is machined by a tool, comprising:

(a) spindle means rotatable about a rotational axis and including chuck means for fixedly clamping a closed end of the workpart with the longitudinal axis of the bore substantially coaxial with the rotational axis, and (b) fluid bearing means in stationary position adjacent an opposite open end of the workpart during machining of said bore and extending around said opposite open end for providing pressurized fluid at sufficient locations around the opposite open end to resist machining forces thereon tending to deflect said opposite open end off the rotational axis relative to the fixedly clamped closed end and thereby improve roundness and straightness of the machined bore.

2. The workhead of claim 1 further including means for adjusting the position of the fluid bearing means on the base member relative to the spindle means.

3. The workhead of claim 1 wherein the fluid bearing means includes a support member having a support bore, a hydrostatic bearing disposed in the support bore, fluid passage means in the support member, fluid passage means in the hydrostatic bearing in registry with the fluid passage means in the support member for conducting pressurized fluid from a source to the hydrostatic bearing.

4. The workhead of claim 3 wherein the bore of said fluid bearing means is a cylindrical bore and includes multiple recessed pockets spaced circumferentially around the bore for receiving pressurized fluid and separated from one another by lands defining portions of a smaller diameter bore and bounded on opposite axial sides by circumferential lands spaced axially apart defining other portions of said smaller diameter bore.

5. A workhead for fixturing and rotating workpart having a thin wall defining a cylindrical bore between opposite ends while said bore is machined by a tool, comprising:

(a) a base member, (b) spindle means disposed on the base member and rotatable about a rotational axis, said spindle means including a chuck means for fixedly clamping a closed end of the workpart with the longitudinal axis of the bore substantially coaxial with the rotational axis, and (c) fluid bearing means disposed on the base member and spaced from the spindle means along the rotational axis in stationary position around an open opposite end of the workpart during machining of said bore, said fluid bearing means having a bore substantially coaxial with the rotational axis for receiving the opposite open end of the workpart and providing pressurized fluid at sufficient locations around said opposite open end to resist machining forces thereon tending to deflect said opposite open end off the rotational axis relative to the fixedly clamped closed end and thereby improve roundness and straightness of the machined bore.

6. The workhead of claim 5 further including means for adjusting the position of the fluid bearing means on the base member relative to the spindle means.

7. The workhead of claim 6 wherein the position adjusting means comprises a slide on which the fluid bearing means is movably disposed on the base member and means for locking the position of the slide.

8. The workhead of claim 5 wherein the fluid bearing means includes a support member having a support bore, a hydrostatic bearing disposed in the support bore, fluid passage means in the support member, fluid passage means in the hydrostatic bearing in registry with the fluid passage means in the support member for conducting pressurized fluid from a source to the hydrostatic bearing.

9. The workhead of claim 5 wherein the bore of said fluid bearing means is a cylindrical bore and includes multiple recessed pockets spaced circumferentially around the bore for receiving pressurized fluid and separated from one another by lands defining portions of a smaller diameter bore and bounded on opposite axial sides by circumferential lands spaced axially apart defining other portions of said smaller diameter bore.

10. A method for fixturing and rotating an elongated workpart having a thin walled defining a cylindrical bore between opposite ends while the bore is machined by a tool, comprising fixedly clamping a closed end of the workpart on a spindle means rotatable about a rotational axis with the longitudinal axis of the bore substantially coaxial with the rotational axis, providing pressurized fluid at sufficient axially stationary locations around an opposite open end of the workpart during machining of said bore to resist machining forces tending to deflect the opposite open end off axis relative to the fixedly clamped closed end, and rotating said spindle means while said pressurized fluid is provided and while the tool machines the bore.

* * * * *